United States Patent [19]

Furutsu

[11] Patent Number: 4,971,238

[45] Date of Patent: Nov. 20, 1990

[54] TAG ATTACHING APPARATUS

[75] Inventor: Akira Furutsu, Tokyo, Japan

[73] Assignees: Japan Bano'k Co., Ltd., Tokyo, Japan; Ben Clements & Sons, Inc., South Hackensack, N.J.

[21] Appl. No.: 227,385

[22] Filed: Aug. 2, 1988

[51] Int. Cl.[5] ..... B65C 7/00

[52] U.S. Cl. ..... 227/2; 227/67; 227/131; 173/123

[58] Field of Search ..... 227/67, 131, 2; 173/123

[56] References Cited

U.S. PATENT DOCUMENTS

| | | | |
|---|---|---|---|
| 2,051,053 | 8/1936 | Morris | 173/123 X |
| 3,589,588 | 6/1971 | Vasku | 227/132 |
| 3,735,908 | 5/1973 | Kinney et al. | 227/67 |
| 4,465,218 | 8/1984 | Furutsu | 227/67 |

*Primary Examiner*—Frank T. Yost
*Assistant Examiner*—Rinaldi Rada
*Attorney, Agent, or Firm*—Blum Kaplan

[57] ABSTRACT

A tag attaching apparatus in which the transverse bar of a tag pin is pushed out of a hollow needle located at the front of the apparatus body by a piston, and which comprises a motor for driving the piston, a converter for transforming the motor rotation into reciprocating motion of the piston, and a control for returning the piston to the home position.

11 Claims, 10 Drawing Sheets

TAG ATTACHING APPARATUS

BACKGROUND OF THE INVENTION

In manually operated tag attaching apparatuses such as described in the U.S. Pat. No. 4,465,218, a spring interposed between an intermediate lever and a body produces resistance against a trigger lever being pulled. Thus, an operator will easily get tired and it is practically impossible to use such a tag attaching apparatus continuously for a long period of time.

The tag attaching apparatus described in the Australian Patent No. 471,689 employs compressed air as a driving source so that the continuous use of the apparatus for a long period of time will not tire the operator as much as does the manually operated tag attaching apparatus.

The tag attaching apparatus using the compressed air, however, needs to be made sturdy and thus becomes heavy compared with the manual tag attaching apparatus, making it unsuitable for a long continuous use.

This apparatus also requires a compressor which will increase the size of the facility and therefore the cost of production.

Furthermore, the tag attaching apparatus and the compressor must be connected with a pressure-resistant hose. With a sturdy pressure-resistant hose connected to the tag attaching apparatus, the apparatus becomes difficult to handle, significantly reducing the maneuverability.

SUMMARY OF THE INVENTION

This invention has been accomplished with a view to overcoming the drawbacks of the conventional tag attaching apparatuses. The object of the invention is to provide a powered tag attaching apparatus which is lightweight, compact and inexpensive and which has good operability and serviceability.

To achieve the above objective, the tag attaching apparatus of this invention comprises a motor for driving a piston to push the transverse bar of a tag pin, a convertor means for transforming the rotation of the motor into reciprocating motion of the piston, and a control means for returning the piston to the initial or home position.

The tag attaching apparatus of this invention, as it is powered by motor, is lighter, more compact and less expensive than the conventional apparatus which uses compressed air as a driving source. Further, since it does not require a pressure-resistant hose for supplying compressed air, it is easier to handle and has better maneuverability than the conventional tag attaching apparatuses that use compressed air.

The control means mentioned above consists of a controller for rotating the motor in a forward or reverse direction and another controller for stopping the piston at the initial or home position. The controller for turning the motor in a forward or reverse direction includes first and second switches and first and second relays. The controller for stopping the piston at the home position includes a third switch.

More specifically, the above control means consists of a first switch for starting the motor and resetting the system of the control means to the initial state, a second switch that is operated when the piston is most advanced, a first relay that self-holds in response to the signal from the second switch, a second relay that reverses the rotation of the motor in response to the signal from the first relay, and a third switch that stops the motor when the piston reaches the home position. This control means enables the piston to stop at the home position even when the trigger is held pulled.

Another control means consists of a first switch for starting the motor, a variable resistor for setting the time period during which the motor is driven, an integrated circuit for turning the motor for a prescribed time in response to the signal from the first switch, a second switch that is operated when the piston is most advanced, a second relay for reversing the motor rotation in response to the signal from the second switch, and a third switch for stopping the motor when the piston reaches the home position and at the same time resetting a system of the control means to the initial state. This control means allows the piston to return to the home position automatically without having to keep the trigger pulled.

Furthermore, since the tag attaching apparatus of this invention has at the back of its body an oscillation prevention guide for the tag pin assembly installed in such a way that it can be pivoted up and down, the tag pin assembly can easily be engaged with the oscillation prevention guide.

The tag attaching apparatus of this invention also has a tag pin feeding means in the body which consists of a tag pin feed wheel engaging with the connecting portions of the tag pin assembly, a rotating means for rotating the feed wheel, and a backward rotation prevention means for preventing the feed wheel from turning in the reverse direction. Because of this construction, the apparatus of this invention can be used with tag pin assemblies having varying intervals between the tag pins, i.e., those with different tag pin pitches.

DESCRIPTION OF THE PREFERRED EMBODIMENT

In the following we will explain an embodiment of this invention by referring to the attached drawings.

Figure 16:
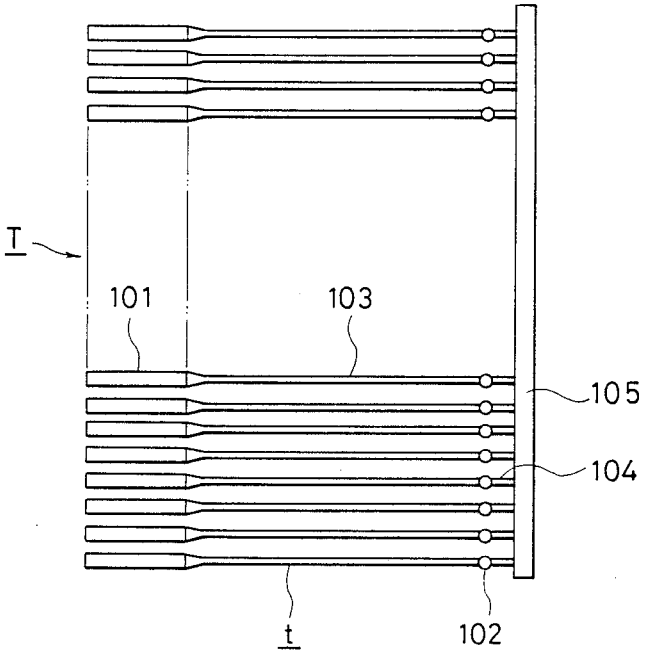
FIG. 16 is a front view of the tag pin assembly.
Figure 17:
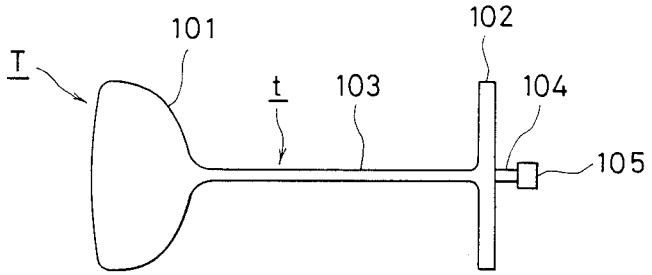
FIG. 17 is a plan view of the tag pin assembly.

As shown in FIGS. 16 and 17, a tag pin t consists of a head 101, a transverse bar 102, and a filament connecting these two members. A tag pin assembly T consists of a number of tag pins t erected on a base bar 105 through each connecting portion 104, like comb teeth. The tag pin assembly T is formed integral as one part using synthetic resin such as nylon and polypropylene.

Figure 1:
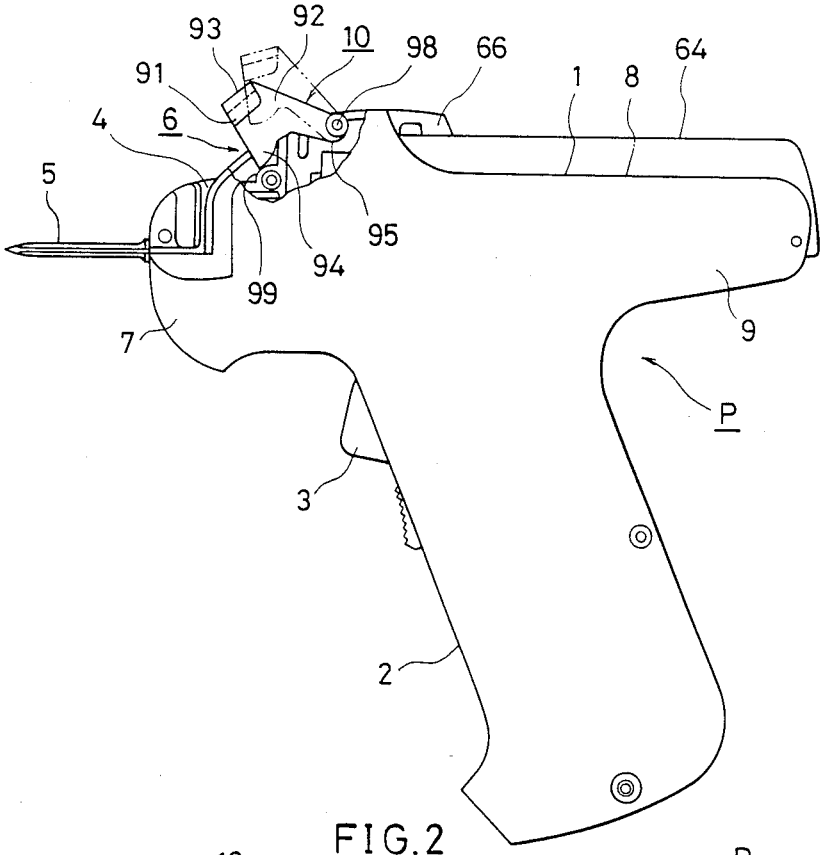
FIG. 1 is a partially cross-sectional side view of a tag attaching apparatus according to this invention.

The tag pin t serves as a connecting member when attaching a tag to merchandise and is driven out by the tag attacher P as shown in FIG. 1.

The tag attaching apparatus P according to this invention is almost T-shaped as shown in FIG. 1 with a lever type trigger 3 located at the front of a grip 2. A head portion 7 of the body 1 of the tag attaching apparatus P is provided with a guide groove 4 in which the tag pin assembly T is inserted. At the forefront of the body is mounted a hollow needle 5 through which the transverse bar 102 of the pin t is pushed out.

Figure 2:
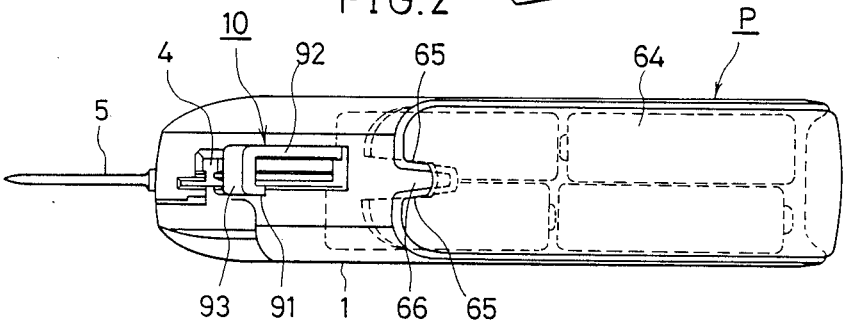
FIG. 2 is a plan view of the tag attaching apparatus of FIG. 1.

As shown in FIG. 1, an oscillation prevention guide 10 is pivotably mounted at a shoulder 6 raised behind the guide groove 4 to prevent oscillation of the tag pin assembly T. The guide 10, as shown in FIG. 2, is hook-shaped, consisting of a tongue portion 91, a side wall portion 92, and a peak portion 93 connecting these two members. The side wall portion 92 has two front and rear legs 94, 95 with the rear leg 95 mounted to the body 1 through a pin 98. The front leg 94 normally is in contact with a seat 99 of the body 1 to keep the guide 10 from sinking excessively forwardly.

Figure 3:
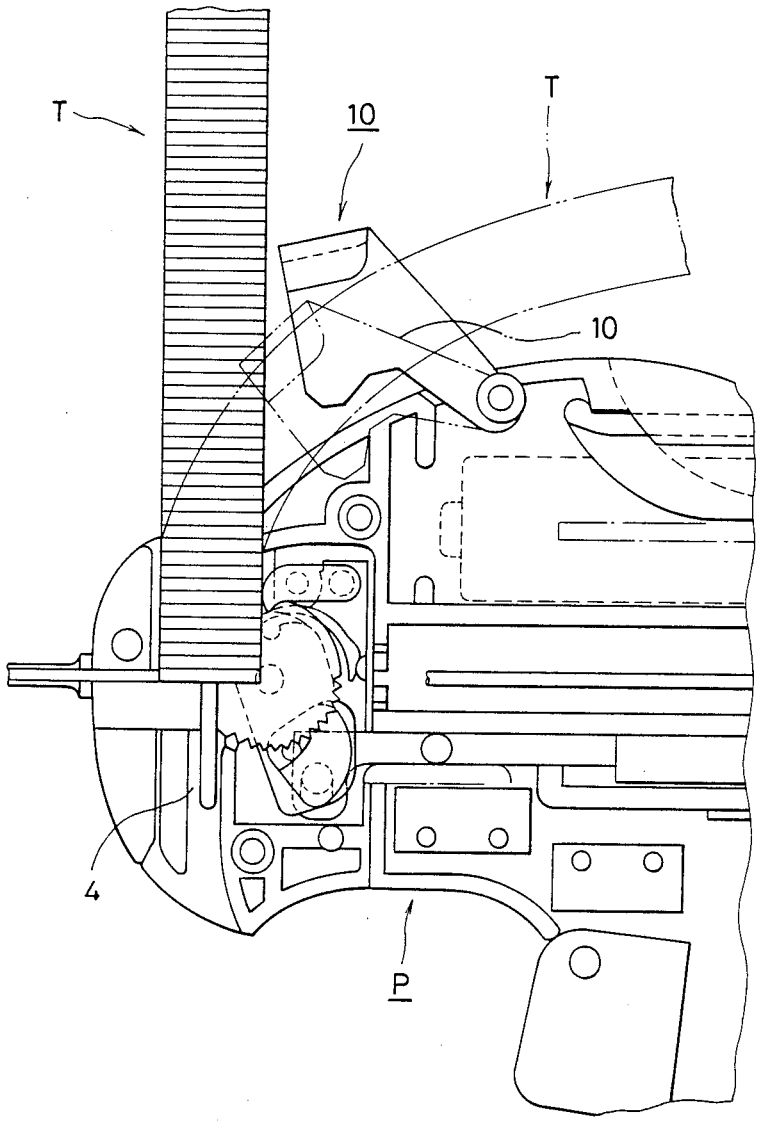
FIG. 3 is an explanatory drawing showing the process of supporting the tag pin assembly by the oscillation prevention guide.
Figure 4:
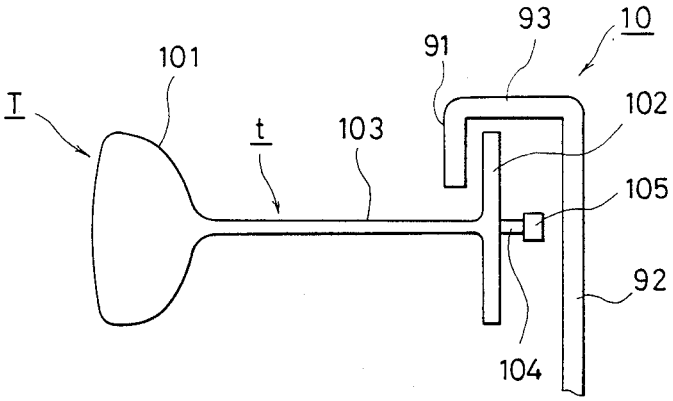
FIG. 4 is an explanatory drawing showing the tag pin assembly being supported by the oscillation prevention guide.

To hold the tag pin assembly T with the guide 10, the guide 10 is pulled back as indicated by solid line in FIG. 3 and the tag pin assembly T is inserted into the guide groove 4. Then, the tag pin assembly T is bent toward the back of the tag attaching apparatus P, as indicated by two-dot line, and as shown in FIG. 4 the base bar 105 and the transverse bar 102 are pushed into the guide 10. This is followed by the guide 10 being set in the front position or seated position as indicated by two-dot line. Then, when released from hand, the tag pin assembly T tends to rise by its own resiliency and is held by the guide 10. The transverse bars 102 are supported by the peak portion 93 of the guide 10, thus preventing the tag pin assembly T from oscillating.

This oscillation prevention guide 10 is also applicable to manual tag attaching apparatuses.

Figure 5:
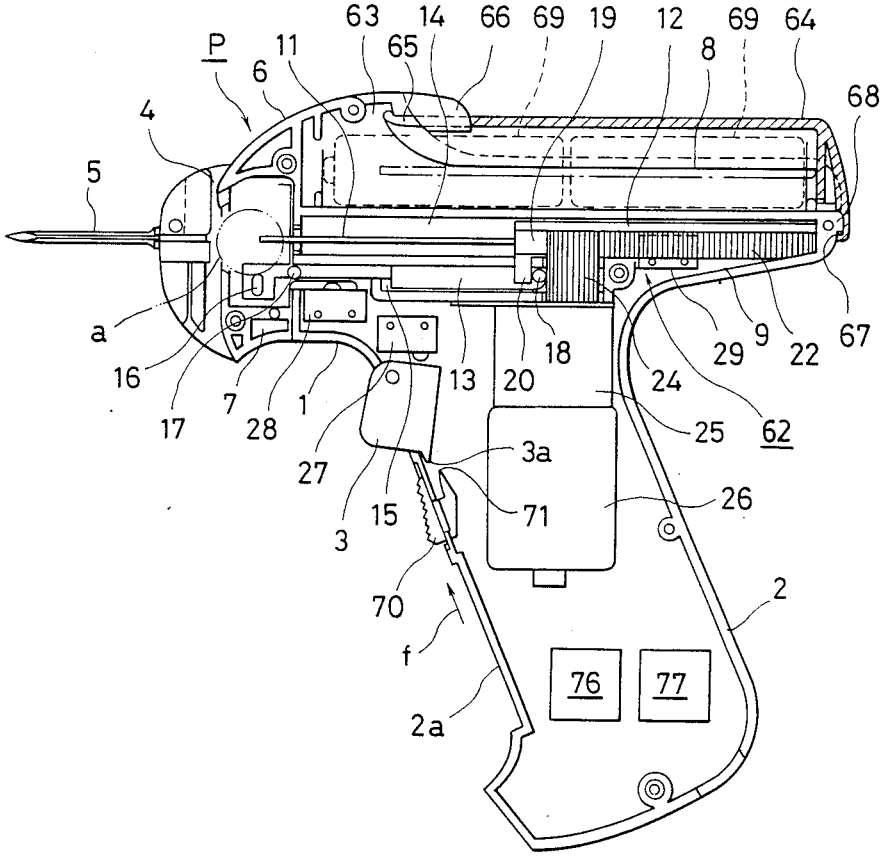
FIG. 5 is a front view showing the inner construction of the tag attaching apparatus of this invention.
Figure 9:
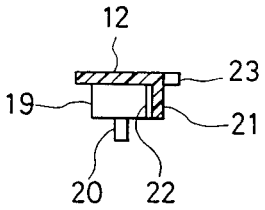
FIG. 9 is a cross-sectional view taken along the line IX—IX of FIG. 8.
Figure 8:
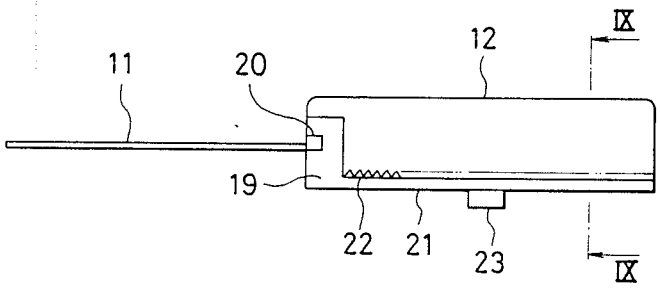
FIG. 8 is a bottom view of a slider.

The internal structure of the tag attaching apparatus P is shown in FIG. 5. A piston 11 for pushing the transverse bars 102 through a hollow needle 5 one at a time is secured to a head portion 19 of a slider 12. The slider 12 is slidably installed in a first groove 14 in the body 1 and has at the underside of the head portion 19 a slide bar 13 and a first projection 20 for activating a second switch 28. As shown in FIG. 9, the slider 12 is L-shaped in a lateral cross section with a rack 22 formed at the inner surface of a side wall portion 21. At the outer surface of the side wall portion 21 is formed a second projection 23 to activate a third switch 29. This projection 23 is almost centered on the slider 12 as shown in FIG. 8.

The slide bar 13 slidably installed in a second groove 15 in the body 1 is almost L-shaped when viewed from the side and has a vertically elongate slot 16 at the head. The slide bar 13 also has a first projection 17 and a second projection 18 at its side.

Figure 6:
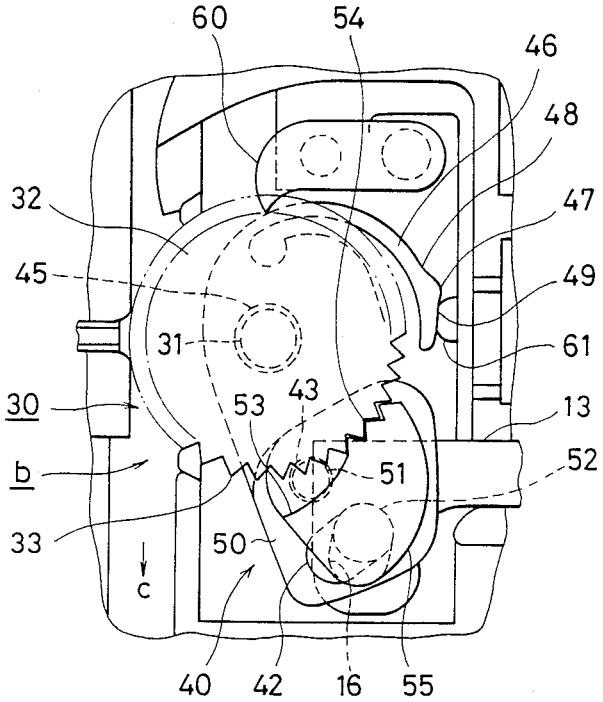
FIG. 6 is a front view of a feeding device according to this invention.

In FIG. 5, a feeding device b for feeding the tag pin assembly T is mounted on the body 1 at location a. The feeding device b, as shown in FIG. 6, consists of a feed wheel 30 that engages with the connecting portions 104 of the tag pin assembly T, a rotating means 40 for rotating the feed wheel 30, and a backward rotation prevention claw 60 for preventing the feed wheel 30 from rotating in the reverse direction.

Figure 7:
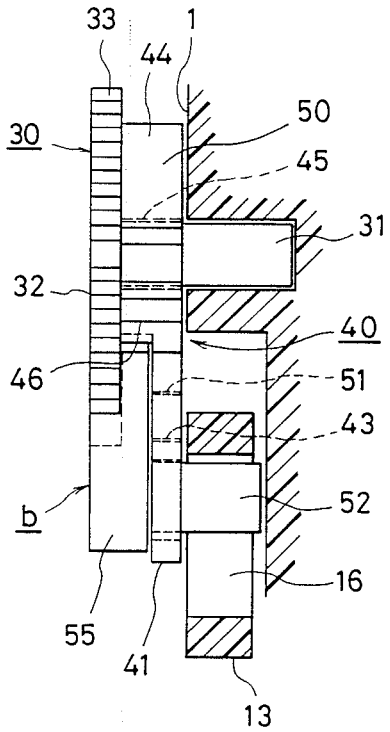
FIG. 7 is a side view of the feeding device of FIG. 6.

The feed wheel 30 consists of a disk 32 with fine saw teeth 33 formed on the circumferential surface thereof which engage with the connecting portions 104 of the tag pin assembly T. The feed wheel 30, as shown in FIG. 7, is rotatably mounted on the body 1 through its shaft 31.

The rotating means 40 consists of an arm 46, an oscillating portion 50, and a pawl 55. The pawl 55 has two shafts—first and second shafts 51, 52—and is rotatably mounted on a thinned part 41 of the oscillating portion 50 through the first shaft 51. The second shaft 52 is passed through an arc hole 42 formed in the thinned part 41 to project into the slot 16 of the slide bar 13. The arc hole 42 is formed on a circle having for its center a first hole 43 in which the first shaft 51 is inserted, so that the pawl 55 can be rotated about the first shaft 51. The pawl 55 has claws 54 at a wall portion 53 facing the teeth 33 of the disk 32 to engage with the mating teeth 33.

A thickened part 44 of the oscillating portion 50 has a second hole 45 through which the shaft 31 of the feed wheel 30 passes. The arm 46 projects from the top of the oscillating portion 50 along its side and has, from the tip toward the base, a first recess 49, a raised portion 47 and a second recess 48 near the front end. These recesses 48, 49 are adapted to engage with a stopper 61 mounted to the body 1. The arm 46 and the oscillating portion 50 are formed integral, with the arm 46 having a resilient force.

Figure 10:
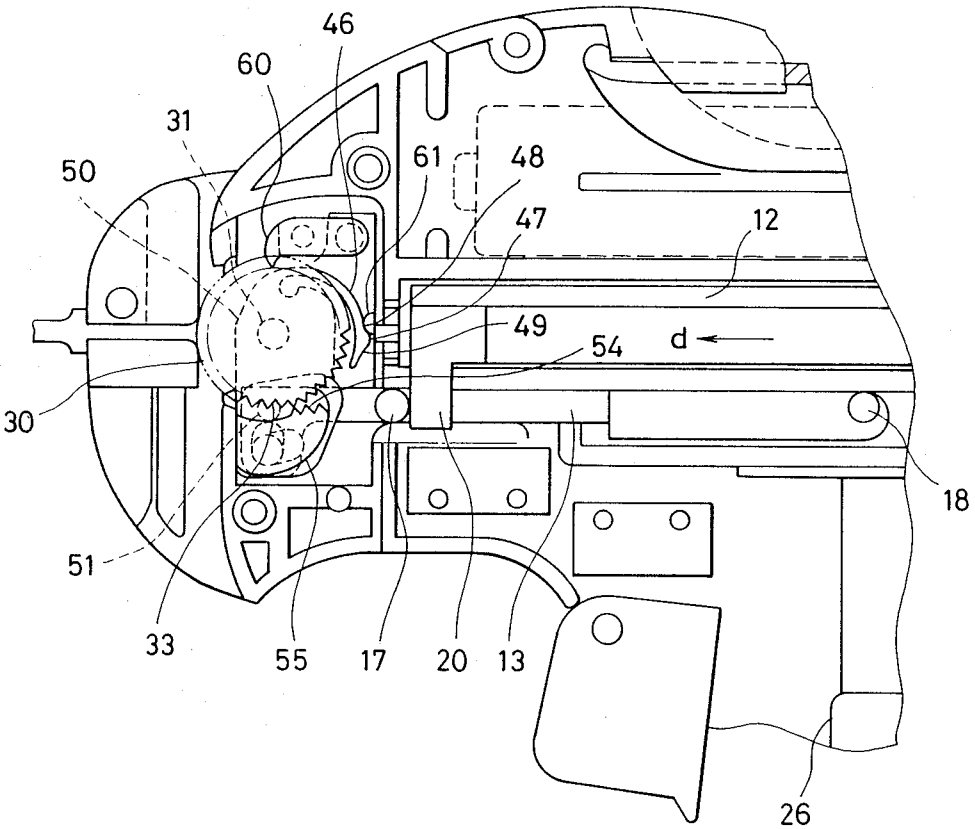
FIGS. 10 and 11 are explanatory drawings showing the action of the feeding device of FIG. 11.

As the motor 26 rotates in the forward direction and the slider 12 is advanced in the direction indicated by the arrow d of FIG. 10, the first projection 20 of the slider 12 comes into contact with the first projection 17 of the slide bar 13 causing the slide bar 13 to advance along with the slider 12. As the slide bar 13 moves forward, it causes the pawl 55 to rotate clockwise about the first shaft 51, disengaging the claw 54 of the pawl 55 from the teeth 33 of the feed wheel 30. At this time, the first recess 49 of the arm 46 is engaged with the stopper 61, so that the rotation of the oscillating portion 50 is prevented. As the slide bar 13 further advances, the oscillating portion 50 is rotated clockwise about the shaft 31 of the feed wheel 30 until the pawl 55 moves to almost the six o'clock position, at which time the raised portion 47 of the arm 46 rides over the stopper, bringing the second recess 48 into engagement with the stopper 61.

Figure 11:
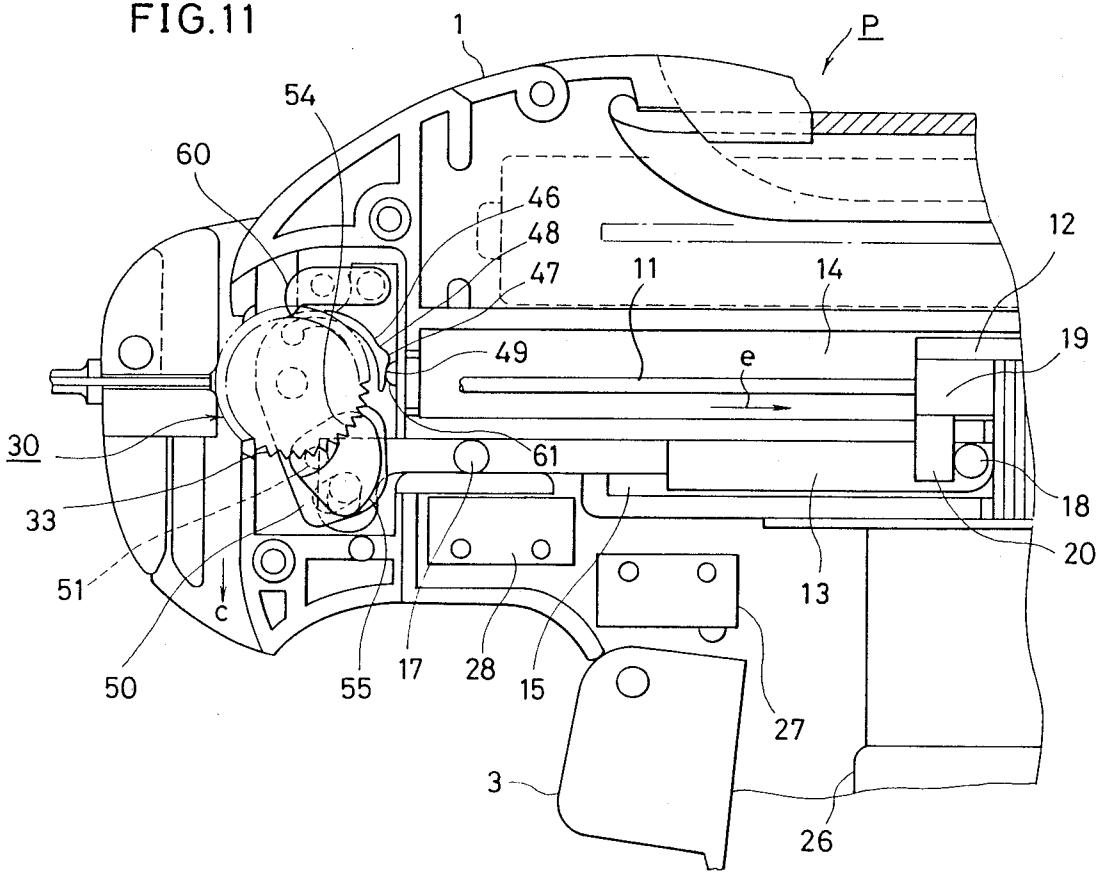

When the motor 26 rotates in the reverse direction and the slider 12 is retracted in the direction indicated by the arrow e of FIG. 11, the first projection 20 of the slider 12 comes into contact with the second projection 18 of the slide bar 13. As the slide bar 13 moves back, the pawl 55 is rotated counterclockwise about the shaft 51 bringing the claw 54 of the pawl 55 into engagement with the teeth 33 of the feed wheel 30. At this time, the second recess 48 of the arm 46 is engaged with the stopper 61, so that the oscillating portion 50 is prevented from rotating. As the slide bar 13 moves farther back and the oscillating portion 50 is rotated counterclockwise, the pawl 55 which is rotating counterclockwise with its claw 54 engaged with the teeth 33 of the feed wheel 30 causes the feed wheel 30 to rotate counterclockwise. Since the teeth 33 of the feed wheel 30 is engaged with the connecting portions 104 of the tag pin assembly T, the counterclockwise rotation of the feed wheel 30 feeds the tag pin assembly T in the direction indicated by the arrow c, sending the lowermost tag pin t to the front of the hollow needle 5. At the same time, the raised portion 47 of the arm 46 rides over the stopper 61 and the first recess 49 engages with the stopper 61.

As shown in FIG. 5, the rack 22 of the slider 12 is meshed with a pinion 24 to form a converter means 62 for transforming the rotation of the motor 26 into reciprocating motion of the piston 11. A first switch 27 is located near the trigger 3; a second switch 28 is installed in the head portion 7 of the body 1 to be activated by the first projection 20 of the slider 12; and a third switch 29 is provided in a tail portion 9 of the body to be activated by the second projection 23 of the slider 12.

In the back 8 of the body 1 is formed a battery chamber 63 in which a plurality of batteries 69 are installed to power the motor 26. A cover 64 of the battery chamber 63 is mounted on the body 1 by means of a front two-legged part 65 and a rear hook 67. As shown in FIG. 2, the two-legged part 65 straddles a saddle portion 66 of the body 1 and the hook 67 at the rear end of the body 1 engages with a projection 68 at the back of the battery chamber 63. The motor 26 may be driven by a direct current supplied from outside rectified by a rectifier not shown, instead of the batteries 69.

Also, as shown in FIG. 5, the grip 2 is provided with a safety lever 70 which is made slidable. When the safety lever 70 is pushed up, a claw 71 of the lever 70 engages with a projection 3a of the trigger 3, thus locking the trigger 3.

Figure 12:
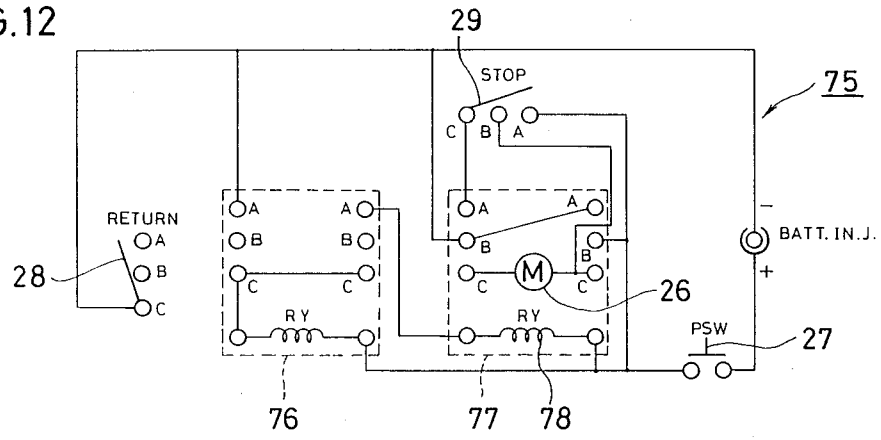
FIGS. 12 and 13 are electric circuitry applied to the tag attaching apparatus of this invention.

A control means 75 for controlling the rotation of the motor 26 is shown in FIG. 12 and consists of a first switch 27 for starting the motor 26 and at the same time resetting the system of the control means 75 to the initial state, a second switch 28 which is activated when the piston 11 is most advanced, a first relay 76 that self-holds in response to a signal from the second switch 28, a second relay 77 that reverses the rotation of the motor 26 in response to a signal from the first relay 76, and a third switch 29 for stopping the motor 26 when the piston 11 returns to the home position. The control means 75 works as follows.

(1) When the trigger 3 is pulled and the first switch 27 is turned on, the motor 26 rotates in the forward direction and the slider 12 advances in the direction indication by the arrow d. The slide bar 13 that advances together with the slider 12 causes the claw 54 of the pawl 55 of the rotating means 40 to disengage from the teeth 33 of the feed wheel 30 and to move to the almost six o'clock position.

(2) When the piston 11 reaches the most advanced position, the first projection 20 of the slider 12 pushes the second switch 28, causing the first relay 76 to operate and self-hold.

(3) The operation of the first relay 76 sends a signal to the coil 78 of the second relay 77, which is then operated.

(4) When the second relay 77 operates, the polarity of the motor 26 is reversed so that the motor 26 which has been rotating in the forward direction reverses its rotation, retracting the slider 12 in the direction indicated by the arrow e.

(5) As the slide bar 13 is retracted by the slider 12, it causes the claw 54 of the pawl 55 of the rotating means 40 to engage with the teeth 33 of the feed wheel 30. As the slide bar 13 moves farther back, the pawl 55 which is rotating counterclockwise causes the feed wheel 30 to turn counterclockwise. When the slider 12 further retracts to cause its second press the third switch 29, projection 23 to the motor 26 is stopped by electrical braking bringing the piston 11 to a halt at the home position.

(6) Next, when the trigger 3 is released and the first switch 27 is turned off, the power to the entire control circuit 75 is turned off, resetting the circuit to the initial state.

Figure 13:
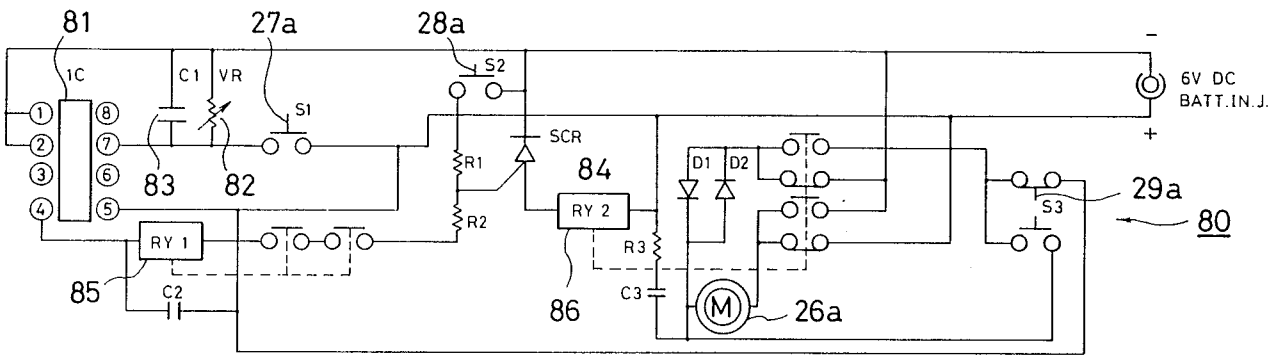

FIG. 13 shows another control means. The control means 80 consists of a first switch 27a for starting the motor 26, a variable resistor 82 for setting the time period during which to drive the motor 26, an integrated circuit 81 for rotating the motor 26 for a prescribed period of time in response to a signal from the first switch 27a, a second switch 28a that is operated when the piston 11 is most advanced, a second relay 86 for reversing the rotation of the motor 26 in response to a signal from the second switch 28a, and a third switch 29a for stopping the motor 26 when the piston returns to the home position and at the same time resetting the system of the control circuit to the initial state.

In the figure, reference number 83 denotes a capacitor which cooperates with the variable resistor 82, and 84 signifies a thyristor for the reversing circuit with a fixed setting.

The control circuit 80 works as follows.

(1) When the trigger 3 is pulled and the switch 27a is turned on, the time setting integrated circuit 81 turns the first relay 85 on for a specified period of time.

(2) When the relay 85 is turned on, current is supplied to the motor 26 which then rotates in the forward direction. This causes the slider 12 to advance, bringing the pawl 55 of the rotating means 40 out of engagement with the teeth 33 of the feed wheel 30 and moving it to almost the six o'clock position.

(3) When the slider 12 advances farther and the piston reaches the most advanced position, the second switch 28a is turned on by the first projection 20 of the slider 12 to apply voltage to the thyristor 84 causing the second relay 86 to self-hold.

(4) When the second relay 86 operates, the polarity of the motor reverses, causing the motor 26 to turn in the backward direction. And the slider 12 retracts in the direction indicated by the arrow e.

(5) As the slider 12 retracts, the feed wheel 30 is rotated counterclockwise by the rotating means 40. Then the second projection 23 of the slider 12 presses the third switch 29a.

(6) With the third switch 29a pressed, a braking circuit is activated to bring the motor 26 to a quick halt and the slider 12 is returned to the home position. At the same time, the power to the entire control circuit is turned off.

(7) If the series of the above operations from step 1 through step 6 fails to be completed within a time period set by the time setting integrated circuit 81, the operation is stopped halfway.

(8) In that case, the trigger 3 is pulled again by an operator to repeat the operation from step 1 to step 6, returning the piston 11 to the home position.

Figure 14:
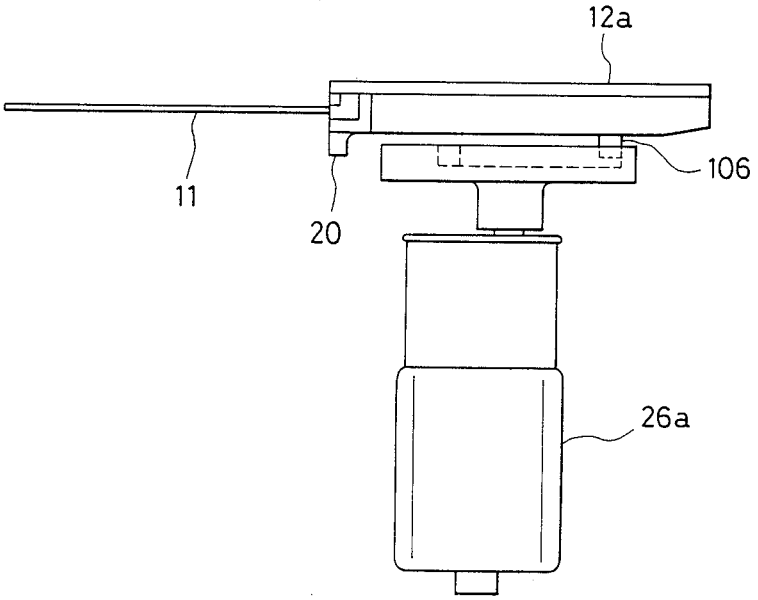
FIG. 14 is a side view of another mechanism for reciprocating the piston.
Figure 15:
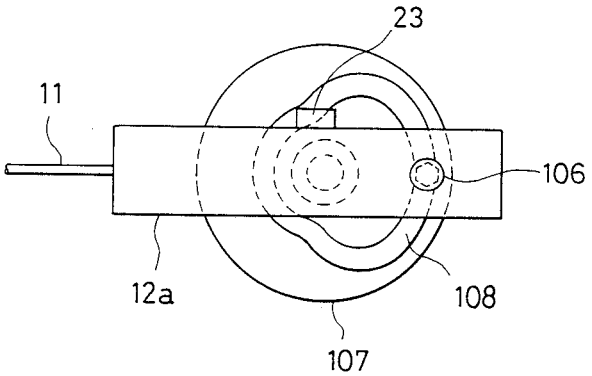
FIG. 15 is a plan view of the piston reciprocating mechanism of FIG. 14.

As shown in FIG. 14 and FIG. 15, the slider 12*a* can also be reciprocated by engaging a projection 106 of the slider 12*a* with an annular cam groove 108 of the cam 107. This construction allows the use of an ordinary motor 26*a* that turns only in one direction and therefore obviates the second switch and its associated circuits, making the apparatus less expensive. In this case, the projection 106 and the cam 107 act as a means 62 for transforming the motor rotation into the reciprocating motion of the piston.

I claim:

1. A tag attaching apparatus comprising:

a body;

a hollow needle mounted at a front end portion of said body;

a guide groove provided in said body, facing an inlet opening of said hollow needle;

a feeding device for intermittently advancing a tag pin assembly loaded in said guide groove;

a piston for pushing tag pins individually successively severed from said tag pin assembly through and out of said hollow needle;

an electric motor for driving said piston and said feeding device;

converter means for transforming the rotation of said electric motor into recriprocating motion of said piston;

control means for returning said piston to an initial position of its reciprocal stroke; and the control means including a first switch for starting the motor;

a variable resistor for setting a time period during which the motor is driven;

an integrated circuit for rotating the motor for a prescribed period of time in response to a signal from the first switch;

a second switch that is operated when the piston is most advanced;

a second relay that reverses the rotation of the motor in response to a signal from the second switch; and a third switch that stops the motor when the piston returns to the home position and at the same time resets the control means to the initial state;

a trigger for starting or stopping said electric motor;

wherein said control means comprises a first controller for reversing the rotation of said electric motor and a second controller for stopping said piston at said initial position in the condition of said trigger being pulled in.

2. A tag attaching apparatus comprising:

a body;

a hollow needle mounted at a front end portion of said body;

a guide groove provided in said body, facing an inlet opening of said hollow needle;

a feeding device for intermittently advancing a tag pin assembly loaded in said guide groove;

a piston for pushing tag pins individually successively severed from said tag pin assembly through and out of said hollow needle;

an electric motor for driving said piston and said feeding device;

converter means for transforming the rotation of said electric motor into reciprocating motion of said piston;

the control means including a first switch for starting the motor and at the same time resetting the control means to the initial state;

a second switch that is operated when the piston is most advanced;

a first relay that self-holds in response to a signal from the second switch;

a second relay that reverses the rotation of the motor in response to a signal from the first relay; and a third switch that stops the motor when the piston returns to the home position;

control means for returning said piston to an initial position of its reciprocal stroke; and a trigger for starting or stopping said electric motor;

wherein said control means comprises a first controller for reversing the rotation of said electric motor and a second controller for stopping said piston at said initial position in the condition of said trigger being pulled in.

3. A tag attaching apparatus comprising:

a body;

a hollow needle mounted at a front end portion of said body;

a guide groove provided in said body, facing an inlet opening of said hollow needle;

a feeding device for intermittently advancing a tag pin assembly loaded in said guide groove;

said feeding device including a feed wheel for intermittently advancing the tag pin assembly, rotating means for intermittently rotating said feed wheel and a backward rotation prevention member for preventing said feed wheel from being rotated in a reverse direction, said rotating means including an oscillating portion pivotably secured to a shaft of said feed wheel, a pawl pivotably mounted to said oscillating portion and engagable with teeth formed about a peripheral portion of said feed wheel and an arm secured to said oscillating portion for rotating the oscillating portion with an appreciable time lag relative to engaging or disengaging motions of said feed wheel and said pawl;

control means for returning said piston to an initial position of its reciprocal stroke; and a trigger for starting or stopping said electric motor;

wherein said control means comprises a first controller for reversing the rotation of said electric motor and a second controller for stopping said piston at said initial position in the condition of said trigger being pulled in.

4. A tag attaching apparatus comprising a body, a hollow needle located at the front of the body, a piston for individually pushing successive tag pins, a motor for driving the piston; converter means for transforming the rotation of the motor into reciprocating motion of the piston, and control means for returning the piston to a home position the control means including a first controller for controlling the forward and reverse rotation of the motor and a second controller for stopping the piston at the home position.

5. A tag attaching apparatus comprising a body, a hollow needle located at the front of the body, a piston for individually pushing successive tag pins, a motor for driving the piston; converter means for transforming the rotation of the motor into reciprocating motion of the piston, and control means for returning the piston to a home position the control means including:

a first switch for starting the motor and at the same time resetting the control means to the initial state;

a second switch that is operated when the piston is most advanced;

a first relay that self-holds in response to a signal from the second switch;

a second relay that reverses the rotation of the motor in response to a signal from the first relay; and A third switch that stops the motor when the piston returns to the home position.

6. A tag attaching apparatus comprising a body, a hollow needle located at the front of the body, a piston for individually pushing successive tag pins, a motor for driving the piston; converter means for transforming the rotation of the motor into reciprocating motion of the piston, and control means for returning the piston to a home position the control means including:

a first switch for starting the motor;

a variable resistor for setting a time period during which the motor is driven;

an integrated circuit for rotating the motor for a prescribed period of time in response to a signal from the first switch;

a second switch that is operated when the piston is most advanced;

a second relay that reverses the rotation of the motor in response to a signal from the second switch; and a third switch that stops the motor when the piston returns to the home position and at the same time resets the control means to the initial state.

7. A tag attaching apparatus comprising a body, a hollow needle located at the front of the body a piston for individually pushing successive tag pins, a motor for driving the piston; converter means for transforming the rotation of the motor into reciprocating motion of the piston, and control means for returning the piston to a home position and an oscillation prevention guide pivotably mounted at the top of the body to prevent the oscillation of the tag pin assembly.

8. A tag attaching apparatus comprising a body, a hollow needle located at the front of the body a piston for individually pushing successive tag pins, a motor for driving the piston; converter means for transforming the rotation of the motor into reciprocating motion of the piston, and control means for returning the piston to a home position, a tag pin feeding means mounted in the body having a feed wheel that engages with the connecting portions of the tag pin assembly, rotating means for rotating the feed wheel, and a backward rotation prevention device that presents backward rotation of the feed wheel the rotating means including an oscillatory portion, a pawl mounted to the oscillatory portion in an oscillatory manner and engaging with the feed wheel, and an arm mounted to the oscillatory portion and adapted to rotate the oscillatory portion with a small time delay after the engagement or disengagement between the feed wheel and the pawl.

9. A tag attaching apparatus comprising a body, a hollow needle located at the front of the body, a piston for individually pushing successive tag pins, a motor for driving the piston; converter means for transforming the rotation of the motor into reciprocating motion of the piston, and control means for returning the piston to a home position, the control means including a first controller for controlling the forward and reverse rotation of the motor and a second controller for stopping the piston at the home position the control means further comprising;

a first switch for starting the motor and at the same time resetting the control means to the initial state;

a second switch that is operated when the piston is most advanced;

a first relay that self-holds in response to a signal from the second switch;

a second relay that reverses the rotation of the motor in response to a signal from the first relay; and a third switch that stops the motor when the piston returns to the home position.

10. A tag attaching apparatus comprising a body, a hollow needle located at the front of the body, a piston for individually pushing successive tag pins, a motor for driving the piston; converter means for transforming the rotation of the motor into reciprocating motion of the piston, and control means for returning the piston to a home position, the control means including:

a first switch for starting the motor;

a variable resistor for setting a time period during which the motor is driven;

an integrated circuit for rotating the motor for a prescribed period of time in response to a signal from the first switch;

a second switch that is operated when the piston is most advanced;

a second relay that reverses the rotation of the motor in response to a signal from the second switch; and a third switch that stops the motor when the piston returns to the home position and at the same time resets the control means to the initial state.

11. A tag attaching apparatus comprising:

a body;

a hollow needle mounted at a front end portion of said body;

a guide groove provided in said body, facing an inlet opening of said hollow needle;

a feeding device for intermittently advancing a tag pin assembly loaded in said guide groove;

a piston for pushing tag pins individually successively severed from said tag pin assembly through and out of said hollow needle;

an electric motor for driving said piston and said feeding device;

converter means for transforming the rotation of said electric motor into reciprocating motion of said piston;

control means for returning said piston to an initial position of its reciprocal stroke; and a trigger for starting or stopping said electric motor;

wherein said control means comprises a first controller for reversing the rotation of said electric motor and a second controller for stopping said piston at said initial position in the condition of said trigger being pulled in.

* * * * *